US006886374B2

(12) United States Patent
Clifton, Jr.

(10) Patent No.: US 6,886,374 B2
(45) Date of Patent: May 3, 2005

(54) HOLSTERABLE RIGID HANDCUFFS

(76) Inventor: Norman E. Clifton, Jr., 607 Trumpet Vine Ct., Jacksonville, FL (US) 32225

( * ) Notice: Subject to any disclaimer, the term of this patent is extended or adjusted under 35 U.S.C. 154(b) by 0 days.

(21) Appl. No.: 10/428,669

(22) Filed: May 2, 2003

(65) Prior Publication Data

US 2004/0216501 A1 Nov. 4, 2004

(51) Int. Cl.[7] ..... E05B 75/00
(52) U.S. Cl. ..... 70/16
(58) Field of Search ..... 70/15–17; 54/71; 119/816; 128/878, 879

(56) References Cited

U.S. PATENT DOCUMENTS 3,616,665 A * 11/1971 Rosenthal
3,740,997 A * 6/1973 Stefansen et al. ..... 70/16
4,741,051 A * 5/1988 Bible ..... 70/16 X
4,840,048 A * 6/1989 Elam ..... 70/16
5,007,257 A * 4/1991 Thompson ..... 70/16
5,233,848 A * 8/1993 Elam ..... 70/16
5,343,562 A * 9/1994 Bible ..... 70/16 X
5,461,890 A * 10/1995 LeFavor ..... 70/16
5,526,658 A * 6/1996 Cross et al. ..... 70/16
5,555,751 A * 9/1996 Strickland et al. ..... 70/16
5,613,381 A * 3/1997 Savage ..... 70/16
5,680,781 A * 10/1997 Bonds et al. ..... 70/16
5,687,593 A * 11/1997 Cross ..... 70/16
5,732,576 A * 3/1998 Moore et al. ..... 70/16
6,000,249 A * 12/1999 Wilber ..... 70/16
6,574,998 B2 * 6/2003 Kwon ..... 70/16

FOREIGN PATENT DOCUMENTS

GB 2268778 * 1/1994 ..... 70/16

* cited by examiner

*Primary Examiner*—Lloyd A. Gall
(74) *Attorney, Agent, or Firm*—Arthur G. Yeager

(57) ABSTRACT

An improved handcuff is constructed of a handcuff assembly that includes a pair of spaced lock assemblies each carrying a clasp for securing the lock assemblies together. A handle cover assembly is mounted about the connector and the lock assemblies to provide a rigid non-movable connection between the lock assemblies. The cover includes a pair of plate members mounted to the connector and lock assemblies to sandwich the connector and lock assemblies therebetween. The cover also includes a pair of oppositely disposed elongate rigid channel members each having a body including an outer surface and an interior space for enclosing the pair of plate members therein. Securing attachments are included for securing the members together. Each channel member includes a pair of walls connected along one elongate edge and open along another elongate edge to define the interior space therein. The another elongate edges of each channel member are mounted in an abutting relationship with the plate members being enclosed in the interior spaces. An opening is provided through the cover assembly located away from the location of the connector enclosed therein to prevent exposure of the connector and interference with a restraint located in the opening. The cover is available in kit form.

30 Claims, 5 Drawing Sheets

HOLSTERABLE RIGID HANDCUFFS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable.

BACKGROUND OF THE INVENTION

1. Field of the Invention

The present invention pertains to handcuffs and particularly to covering structures used to provide handcuffs that are rigid and holsterable.

2. Relevant Art

Prior art rigid handcuffs typically are formed of two plates that cover the center chain between two clasps and are secured by four spaced bolts. Forces on such handcuffs can cause bending of the plates and cause problems in handling by a user attempting to restrain a handcuffed individual or in applying the handcuffs to an individual to be restrained. What is desired is a far more rigid central covering apparatus and a pair of cuffs that can be holstered and are easy to use quickly. In addition, an opening to allow an additional restraining means to be connected to the apparatus should be included in a manner as to not weaken the cover.

BRIEF SUMMARY OF THE INVENTION

In one aspect of the present invention there is provided a cover for a handcuff assembly that includes a pair of spaced lock assemblies having substantially planar opposite side surfaces connected together by a connecting member and a clasp member attached to each lock assembly for securing a handcuff assembly to limbs of an individual to be restrained, the cover comprising a plurality of members mounted around such handcuff assembly for enclosing connecting means and enclosing lock assemblies to inhibit twisting motion of lock assemblies and connected clasp members about such connecting member. The plurality of members includes a pair of oppositely disposed elongate rigid channel members each having a body including a pair of walls connected along one elongate edge portion and open along another elongate edge portion to define an interior space therein for enclosing a connecting member and attached lock assemblies therein. Also included is securing means for securing the members to lock assemblies. One channel member has a pair of aligned openings therethrough for forming a restraining means opening in the cover. The plurality of members further includes a pair of plate members, each plate member mounted to a connecting member and lock assembly to sandwich a connecting member and attached lock assemblies therein, the plate members are sized to be enclosed within the interior spaces of the channel members. Each plate member has an opening aligned with the openings in the channel member. The outer surface is shaped to conform to the hand of a user grasping the cover. The channel members also include arcuate end portions formed to conform to the facing inner portions of clasp members.

The another elongate edge portion of each channel member is mounted in an abutting relationship, a connecting member and attached lock assemblies being enclosed in the interior spaces. Each opening in one channel member and plate members is located away from the location of a connecting means enclosed therein to prevent exposure of a connecting member and interference with restrain means in restraining means opening. The body of each channel member includes a plurality of rib members projecting inwardly into the interior space for engaging the pair of plate members enclosed therein.

In another aspect of the present invention there is provided an improved handcuff apparatus comprising a handcuff assembly including a pair of spaced lock assemblies each carrying a clasp means or apparatus for securing the assembly to limbs of an individual to be restrained, connection means or member connecting the lock assemblies together, a handle cover assembly mounted about the connecting means and the lock assemblies to provide a rigid non-movable connection between the lock assemblies. The cover assembly includes a pair of oppositely disposed elongate rigid channel members each having a body including an outer surface and an interior space for enclosing the connecting means and the attached lock assemblies therein, and securing means for securing the members together. One channel member has a pair of oppositely disposed aligned openings therethrough for forming a restraining means opening in the cover assembly. The cover assembly further includes a pair of plate member, each member mounted to the connection means and to the lock assemblies to sandwich the connection means and the lock assemblies therein. Each plate member has an opening aligned with the opening in the channel member to form the restraining means opening. The outer surface is shaped to conform to the hand of a user grasping the cover assembly. The channel members include arcuate end portions formed to conform to the facing inner portions of the clasp members. Each channel member includes a pair of walls connected along one elongate edge portion and open along another elongate edge portion to define the interior space therein, the another elongate edge portion of each channel member in an abutting relationship, the plate members being enclosed in the interior spaces. The opening in one channel member and the plate members in the cover assembly is located away from the location connection means enclosed therein to prevent exposure of the connection means and interference with restrain means located in the restraining means opening in the cover assembly. The body of each channel member includes a plurality of rib members projecting inwardly into the interior space for engaging the pair of plate members enclosed therein.

In a further aspect of the present invention there is provided an improved handcuff apparatus comprising a handcuff assembly including a pair of spaced lock assemblies each carrying a clasp means for securing the assembly to limbs of an individual to be restrained, a connection means or member for connecting the lock assemblies together, a handle cover assembly mount about the connection means and the lock assemblies to provide a rigid non-movable connection between the lock assemblies. A pair of oppositely disposed elongate rigid channel members is included, each having a body including an outer surface and an interior space for enclosing the pair of plate members therein, and securing means for securing the members together. Each channel member includes a pair of walls connected along one elongate edge portion and open along another elongate edge portion to define the interior space therein, the another elongate edge portion of each channel member in an abutting relationship, the plate members being enclosed in the interior spaces. There is also an opening through the cover assembly located away from the location of the connection means enclosed therein to prevent exposure of the connection means and interference with a restrain means located in the opening. The body of each channel member includes a plurality of rib members projecting inwardly into the interior space for engaging the pair of plate members. The cover assembly can be provided in a kit form for use with a wide variety of standard handcuffs.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

The improved handcuff apparatus includes a cover made from two inner members that are mounted on either side to enclose the chain and a portion of lock assemblies that carry the respective clasp members. Two U-shaped shell or channel members are positioned over the inner members in an abutting fashion. Spaced bolts or other fasteners are used to secure the parts in place. The channel members are contoured to fit the inner part of the hand of a user who is using the apparatus to restrain a person who is handcuffed. The apparatus can be provided in a kit form that can be used with a wide variety of standard handcuffs.

An opening is provided through the members to provide for the passage of additional restraining means, such as a chain, through the cover.

Figure 1:
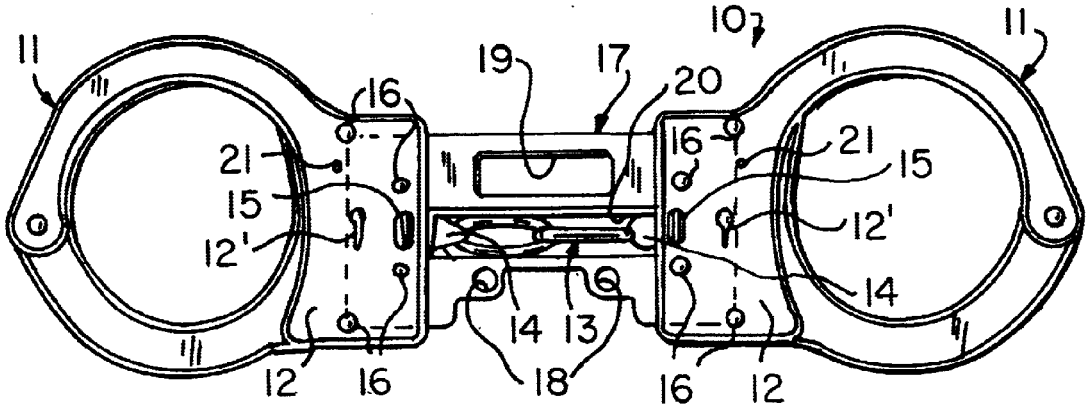
FIG. 1 is a top view of the improved handcuff apparatus employing one inner cover in accord with the present invention.
Figure 2:
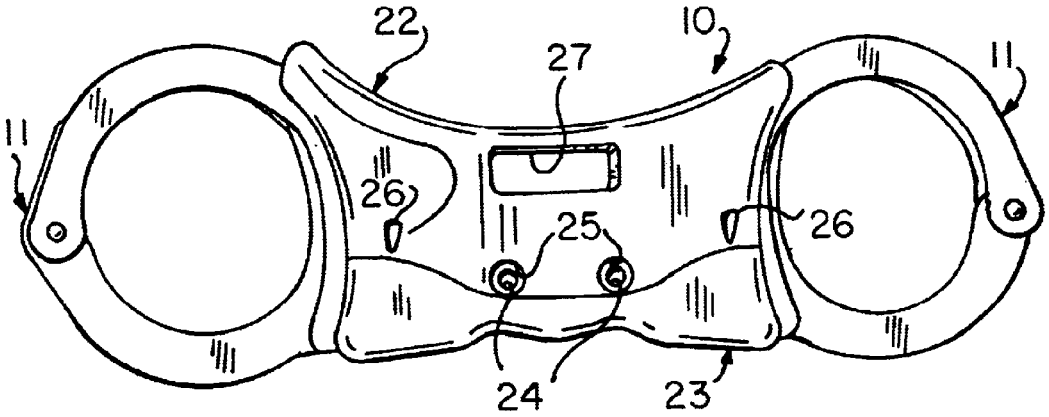
FIG. 2 is a top pictorial view of the handcuff apparatus employing the complete cover of the present invention.

With respect to the drawings, the improved handcuff cover apparatus is indicated at numeral 10 in FIGS. 1 and 2. Two clasps 11 are conventional apparatus as understood in the art. Lock assemblies 12 are secured via pins 16. Securing pins 15 are used with chain connection apparatus 14 to mount chain 13.

One inner plate member 17 is shown in position extending laterally as shown in broken line and includes bolt holes 18 and opening 19 for additional restraint means. Chain 13 fits within an elongate opening 20.

In FIG. 2, upper member 22 has an opening 27 in line with opening 19. Two holes 26 to allow access to keyholes 12' to release internal ratchet pawls (not shown) which are mounted by pins 21. Two spaced bolt holes 24 include countersunk rings 25 to allow the securing means to be flush with the outer surface of member 22. Lower member 23 is secured to abut member 22 as will be discussed hereinbelow.

Figure 3:
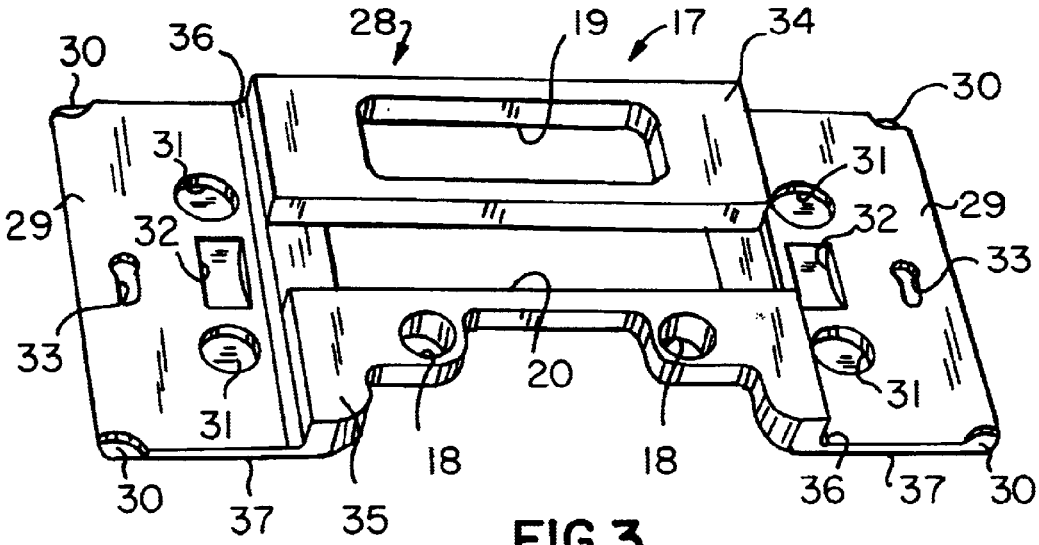
FIG. 3 is a perspective view of the inner surface of one inner member of the cover of FIG. 2.

A detailed perspective of the inside surface of an inner member 17 is illustrated in FIG. 3. Central portion 28 is flanked by two thin flanges 29. Each flange 29 carries two recesses 31 for pins 16 and a recess 32 for chain securing pin 15. Notches 30 provide for mounting member 17 flush against respective pins 16.

Center portion 28 projects inward flush against the inside edges of lock assemblies 12. Plates 34 and 35 help to define opening 20 to accommodate chain 13. In addition, the respective inside faces 34', 35' of plates 34 and 35 (shown in FIG. 4) will abut against the corresponding faces 34 and 35 of the opposite inner member 17 to secure members 17 tightly around the handcuff apparatus. The plate 36 has a slightly curved edge to accommodate the slightly rounded edge of the lock assemblies 12.

Figure 4:
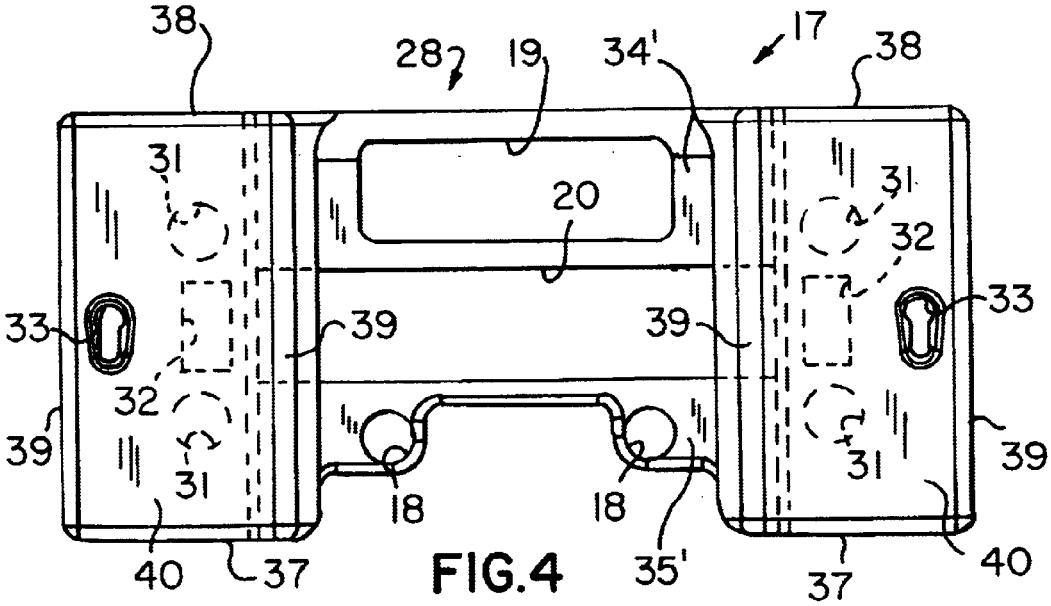
FIG. 4 is a side view of the outer surface of the side shown in FIG. 3.

FIG. 4 illustrates the opposite side of a member 17. Edge portions 37, 38 and 39 extend from surfaces 40 and are formed to provide a smooth fit of the members 17 against the lock assemblies 12.

Figure 5:
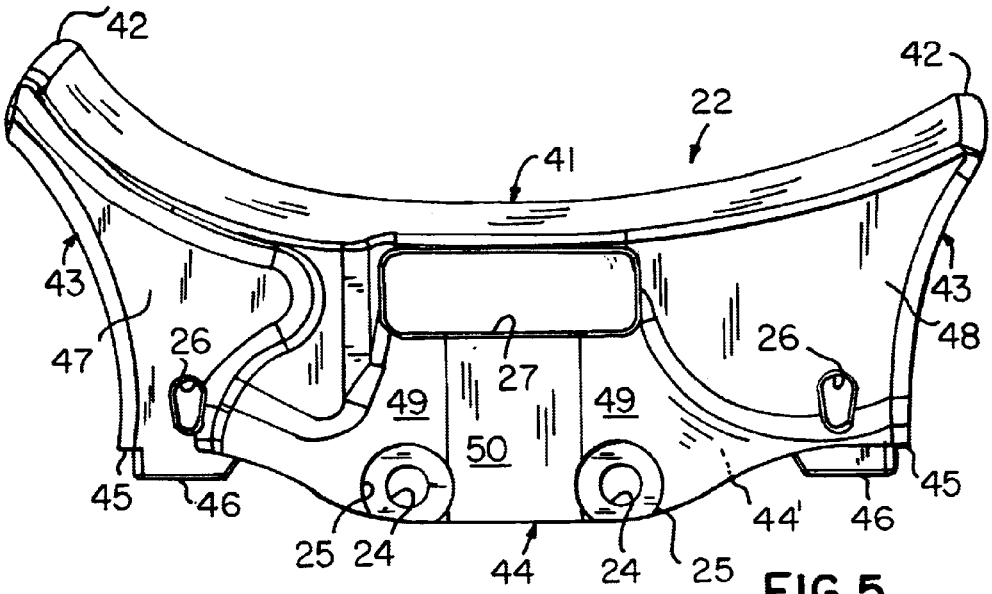
FIG. 5 is a side view of one outer surface of the upper member of the cover of FIG. 2.
Figure 6:
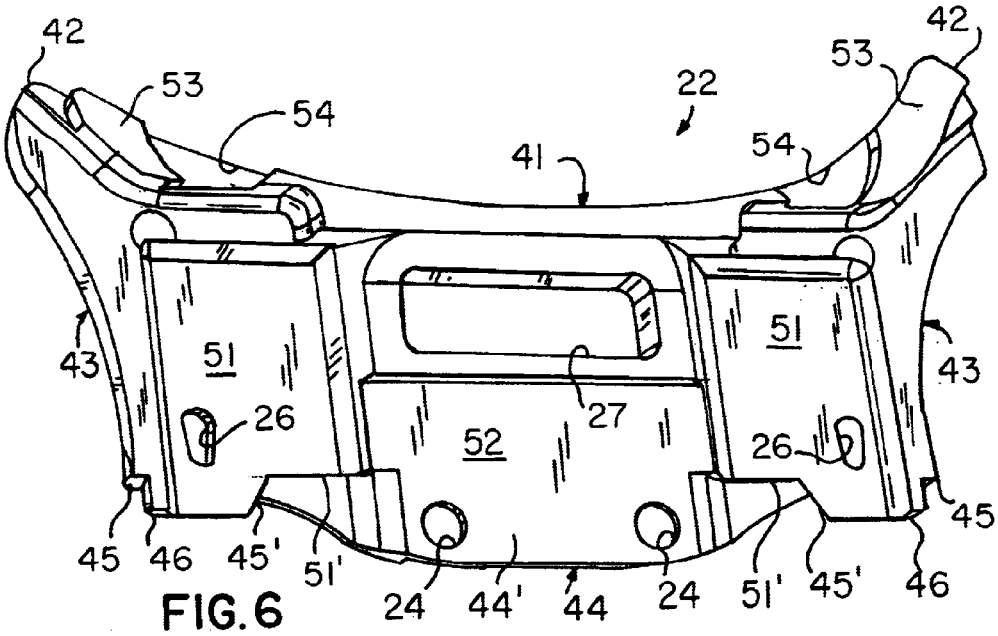
FIG. 6 is a side view of the inner surface of the illustrated member of FIG. 5.

FIGS. 5 and 6 illustrate the larger, upper channel member 22. An upper arcuate elongate folded wall portion 41 includes end portions 42 which are continuous with arcuate sides 43 that conform to the inside arcuate portions of the two lock assemblies 12 and clasp assemblies 11 as shown in FIG. 2. Surfaces 47, 48 and 50 are substantially planar. Surfaces 49 are curved to conform to the surface of a hand of a person grasping the member 22. The wall portion 41 is substantially thicker than the other portions of member 22 to provide for a strong side to the opening 27 to support clamping apparatus (not shown) through the opening.

Bolt holes 24 are countersunk via recesses 25 and the elongate bottom open edges 44 of member 22 define interior space 44'. Openings 26 provide access to the lock assembly 12. Posts 46 have notches 45 and a slanted edge 45' that will be discussed hereinbelow.

The inside of the outside surface shown in FIG. 5 is illustrated in perspective in FIG. 6. Upraised sections 51 fit flush against surfaces 40 of outer flanges 29 of member 17. Ribs 53 reinforce the structure. Cutout portions 54 allow access to pawl locks (not shown) if they are located on the side of the handcuff assembly 10 as is sometimes the case. Upraised surface 52 fits flush against the outside surface of the center portion 28 of member 17. The molded inside structure of member 22 is formed so that member 22 fits over inner members 17 in a very secure tight fit with no discernable movement of member 22 against members 17 when the member 22 is grasped by a user.

Figure 7:
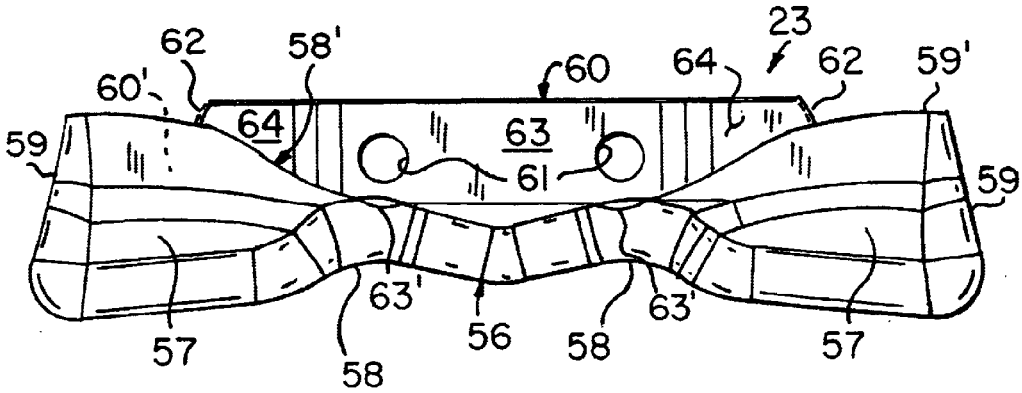
FIG. 7 is a side view of the lower member of the present invention.
Figure 8:
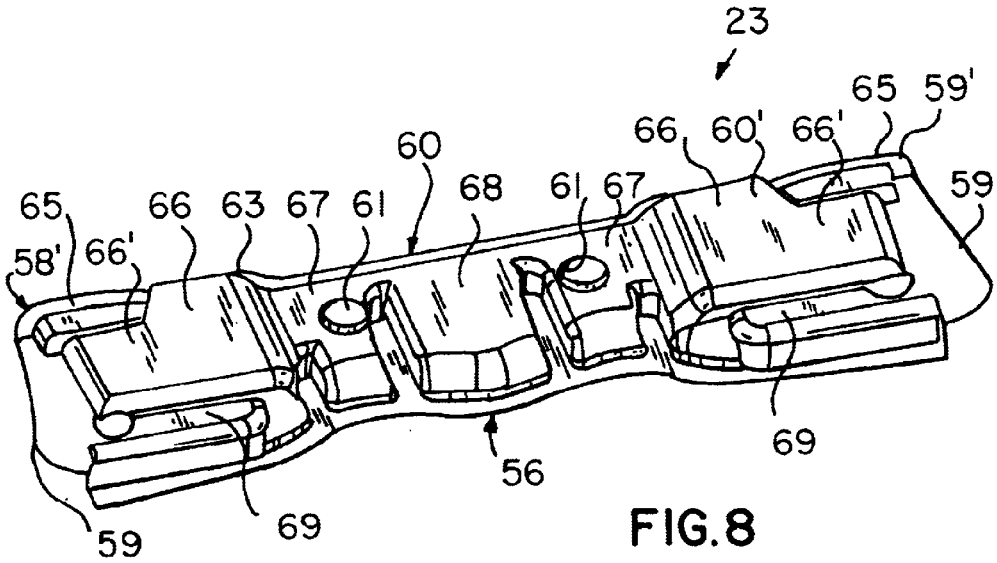
FIG. 8 is a perspective of the inner surface of one side of the member of FIG. 7.

FIGS. 7 and 8 illustrate the lower channel member 23. Elongate lower folded edge portion 56 includes curved portions 58 to provide for grasping and larger contoured end portions 57 that are continuous with end portions 59 and two countersunk portions 63' for bolts 71. Two upstanding spaced elongate wall members 63 each have upper edge 60, bolt holes 61, and downwardly slanted end portions 62. Upper elongate edges 59' define an elongate opening 58' into an interior space 60'.

FIG. 8 illustrates the opposite side of member 23 in perspective. Surfaces 66 have top surface portions 66'. Surface portions 66 and walls 65, 67, 68 and 69 function as reinforcing ribs for stiffness of member 23 and to abut the outer surfaces of members 17 to provide a very secure tight fit of the assembly. Specifically, raised surface 66 fit against outside surfaces 40 of outer flanges 29 and walls 67 and 68 fit against the inside surface 35' of lower plate 35.

Figure 9:
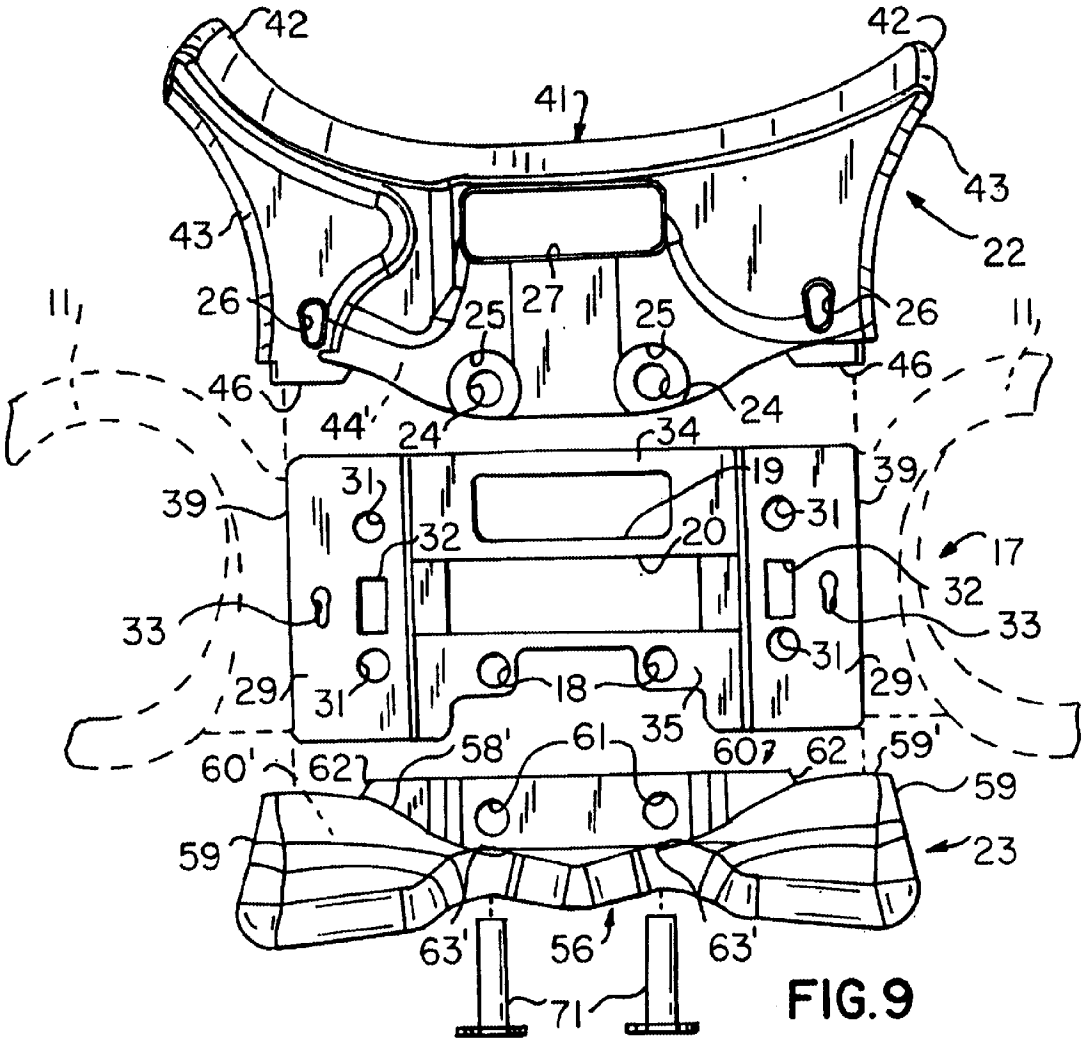
FIG. 9 is an exploded view showing the relationship of the members of FIGS. 1-8.

FIG. 9 illustrates the relative position of the members 17, 22 and 23 as they are installed onto a pair of handcuffs. For ease of illustration only one far side inner member 17 is shown. Clasps 11 and a portion of lock assembly 12 are shown in broken line for purposes of reference.

The first step in assembly of the cover 10 is to place both inner members 17 over the lock assemblies 12 and chain 13. The second step is to place lower member 23 upwardly to align bolt holes 18 and 61. Outer flanges 29 will be positioned between of walls 63.

The third step is to bring upper member 22 downwardly to place elongate openings 58' and 44' into an abutting relationship and to align bolt holes 24 with holes 18 and 61. The posts 46 will be positioned against slanted walls 62. Screws or bolts 71 are then used to secure the members 17, 23, and 22 securely together. The assembled cover 10 is rigid and resistant to distortion due to twisting when grasped by a user employing the handcuffs to restrain a prisoner. The superimposed openings 19 and 27 provide an opening for additional restraint means, such as a leg chain, through the opening.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A cover for a handcuff assembly that includes a pair of spaced lock assemblies having substantially planar opposite side surfaces connected together by a connecting member and a clasp member attached to each lock assembly for securing a handcuff assembly to limbs of an individual to be restrained, said cover comprising a plurality of members mounted around such handcuff assembly for enclosing a connecting member and enclosing lock assemblies to inhibit twisting motion of lock assemblies and attached clasp members about such connecting member and permitting operation of lock assemblies when said cover is in use on said handcuff assembly, said plurality of members including a pair of separate oppositely disposed elongate rigid channel members each having a body closed along one elongate edge portion and open along another elongate edge portion, both said another elongate edge portions facing each other and being open substantially along the length of said connecting member, said pair of channel members including an interior space therebetween for enclosing a connecting member and attached lock assemblies therein and securing means for securing said channel members together with the lock assemblies nested therebetween.

2. The cover as defined in claim 1 wherein one said channel member has a pair of aligned openings through said body for forming a restraining means opening in said cover.

3. The cover as defined in claim 2 wherein said plurality of members further includes a pair of plate members, each said plate member mounted to a connecting member and lock assembly to sandwich a connecting member and attached lock assemblies therein, said plate members sized to be enclosed within said interior space of said channel members.

4. The cover as defined in claim 3 wherein each said plate member has an opening aligned with said openings in said channel member.

5. The cover as defined in claim 1 wherein said channel members are shaped to conform to the hand of a user grasping said cover.

6. The cover as defined in claim 5 wherein said channel members include arcuate end portions formed to conform to the facing inner portions of a clasp member.

7. The cover as defined in claim 1 wherein each said channel member has an outer edge portion adjacent respective said another elongate edge portion said outer edge portion of one said channel member abutting with another said outer edge portion.

8. The cover as defined in claim 4 wherein each said opening in said one channel member and said plate members is located away from the location of a connecting member enclosed therein to prevent exposure of a connecting member and interference with restrain means in said restraining means opening.

9. The cover as defined in claim 3 wherein walls of each said channel member includes a plurality of rib members projecting inwardly into said interior space for engaging said pair of plate members enclosed therein.

10. The cover as defined in claim 1 wherein each said channel member includes a pair of spaced and aligned fastener openings, said securing means including a pair of spaced fasteners respectively passing through said aligned openings.

11. The cover as defined in claim 1 wherein one said closed elongated edge portion is an arcuate folded wall portion to provide enhanced strength thereto.

12. The cover as defined in claim 11 wherein said folded wall portion has a substantially larger thickness than the thickness of other portions of said body having said folded wall portion.

13. The cover as defined in claim 11 wherein another said elongate edge portion is folded to form spaced curved portions.

14. The cover as defined in claim 11 wherein one said channel member includes spaced and aligned openings adjacent said folded wall portion for forming a restraining means opening in said cover.

15. An improved handcuff apparatus comprising a handcuff assembly including a pair of spaced lock assemblies each carrying a clasp member for securing said assembly to limbs of an individual to be restrained, a connection member connecting said lock assemblies and permitting operation of lock assemblies when a cover assembly is in use about said lock assemblies together, a handle cover assembly mounted about said connection member and said lock assemblies to provide a rigid non-movable connection between said lock assemblies, said cover assembly including a pair of separate oppositely disposed elongate rigid channel members each having a body closed along one elongate edge portion and open along another elongate edge portion to define interior space therebetween for enclosing said connection member and said attached lock assemblies therein, both said another elongate edge portions facing each other and being open substantially along the length of said connection member, and securing means for securing said channel members together.

16. The apparatus as defined in claim 15 wherein one said channel member has a pair of oppositely disposed aligned openings therethrough said body for forming a restraining means opening in said cover assembly.

17. The apparatus as defined in claim 16 wherein said cover assembly further includes a pair of plate members, each said member mounted to said connection member and to said lock assemblies to sandwich said connection member and said lock assemblies therein.

18. The apparatus as defined in claim 17 wherein each said plate member has an opening aligned with said openings in one said channel member.

19. The apparatus as defined in claim 15 wherein said handle cover assembly is shaped to conform to the hand of a user grasping said cover assembly.

20. The apparatus as defined in claim 19 wherein said channel members include arcuate end portions formed to conform to the facing inner portions of said clasp member.

21. The apparatus as defined in claim 17 wherein each said channel member has an outer edge portion adjacent respective said another elongate edge portion, said outer edge portion of one said channel member abutting with another said outer edge portion.

22. the apparatus as defined in claim 17 wherein said openings in said one channel member and openings in said plate members in said cover assembly are located away from the location of said connection member, said connection member enclosed therein to prevent exposure of said connection member and interference with restraint means located in said restraining means opening in said cover assembly.

23. The apparatus as defined in claim 17 wherein each said channel member includes a plurality of rib members projecting inwardly into respective said interior space for engaging said plate members enclosed therein.

24. The apparatus as defined in claim 15 wherein each said channel member includes a pair of spaced and aligned fastener openings, said securing means including a pair of spaced fasteners respectively passing through said aligned openings.

25. An improved handcuff apparatus comprising a handcuff assembly including a pair of spaced lock assemblies each carrying a clasp means for securing said assembly to limbs of an individual to be restrained, a connection member for connecting said lock assemblies together, a handle cover assembly mounted about said connection member and said lock assemblies to provide a rigid non-movable connection between said lock assemblies, a pair of plate members and permitting operation of lock assemblies when said cover assembly is in use about said lock assemblies, said members mounted to said connection member and lock assemblies to sandwich said connection member and lock assemblies therein, a pair of separate oppositely disposed elongate rigid channel members each having a body closed along one elongate edge portion and open substantially along another elongate edge portion to define an interior space therein for enclosing said pair of plate members therein, both said another elongate edge portions facing each other, and securing means for securing said channel members together.

26. The apparatus as defined in claim 25 wherein each said channel member has an outer edge portion adjacent respective said another elongate edge portion, said outer edge portion of each said channel member abutting with another said outer edge portion.

27. The apparatus as defined in claim 25 further including an opening through said cover assembly located away from the location of said connection member enclosed therein to prevent exposure of said connection member and interference with a restraining means located in said opening.

28. The apparatus as defined in claim 25 wherein said body of each said channel member includes a plurality of rib members projecting inwardly into respective said interior space for engaging said pair of plate members.

29. The apparatus as defined in claim 25 wherein each said channel member includes a pair of spaced and aligned fastener openings, said securing means including a pair of spaced fasteners respectively passing through said aligned openings.

30. The apparatus as defined in claim 25 wherein one said channel member includes a pair of spaced first portions adjacent said another elongate edge portion, another said channel member including a pair of spaced second portions adjacent said another elongate edge portion of said another said channel member, said first portions having a spaced pair of first openings therethrough, said second portions having a spaced pair of second openings therethrough and being aligned with said first openings, said securing means includes attachment members respectively passing through respective pairs of aligned openings.

* * * * *